US008899143B2

(12) United States Patent
Ho et al.

(10) Patent No.: US 8,899,143 B2
(45) Date of Patent: Dec. 2, 2014

(54) HYDRAULIC CONTROL SYSTEM HAVING VARIABLE PRESSURE RELIEF

(75) Inventors: Aaron Y. Ho, Naperville, IL (US); Bryan A. Johnson, Montgomery, IL (US); Nikhil Jalgaonkar, Schaumburg, IL (US)

(73) Assignee: Caterpillar Inc., Peoria, IL (US)

( * ) Notice: Subject to any disclaimer, the term of this patent is extended or adjusted under 35 U.S.C. 154(b) by 703 days.

(21) Appl. No.: 13/170,482

(22) Filed: Jun. 28, 2011

(65) Prior Publication Data

US 2013/0000288 A1 Jan. 3, 2013

(51) Int. Cl.

| | |
|---|---|
| ***F15B 11/08*** | (2006.01) |
| ***F15B 13/04*** | (2006.01) |
| ***E02F 9/22*** | (2006.01) |
| ***F15B 11/028*** | (2006.01) |

(52) U.S. Cl.

CPC ..... *E02F 9/2214* (2013.01); *F15B 2211/6654* (2013.01); *E02F 9/2296* (2013.01); *F15B 2211/6653* (2013.01); *F15B 2211/30535* (2013.01); *F15B 2211/853* (2013.01); *F15B 11/028* (2013.01); *F15B 2211/6336* (2013.01); *F15B 2211/6346* (2013.01); *E02F 9/2228* (2013.01); *F15B 2211/526* (2013.01); *F15B 2211/30575* (2013.01); *F15B 2211/5159* (2013.01); *F15B 2211/665* (2013.01); *F15B 2211/50518* (2013.01)

USPC ..... 91/449; 91/450; 91/451; 91/358 R

(58) Field of Classification Search

CPC ..... F15B 13/16; F15B 13/02

USPC ..... 91/449–452, 358 R, 353

See application file for complete search history.

(56) References Cited

U.S. PATENT DOCUMENTS

| | | | | |
|---|---|---|---|---|
| 3,937,128 | A | 2/1976 | Hicks et al. | |
| 5,511,458 | A * | 4/1996 | Kamata et al. | 91/361 |
| 6,880,332 | B2 | 4/2005 | Pfaff et al. | |
| 6,938,535 | B2 * | 9/2005 | Price | 91/361 |
| 7,165,395 | B2 * | 1/2007 | Anderson et al. | 60/413 |
| 7,555,855 | B2 * | 7/2009 | Alshaer et al. | 37/382 |
| 2002/0014075 | A1 | 2/2002 | Sawada et al. | |
| 2004/0128868 | A1 * | 7/2004 | Helbling et al. | 37/348 |

(Continued)

FOREIGN PATENT DOCUMENTS

| | | |
|---|---|---|
| JP | 09088126 | 3/1997 |
| JP | 2007154478 | 6/2007 |
| WO | 2010054155 | 5/2010 |

*Primary Examiner* — Edward Look
*Assistant Examiner* — Daniel Collins
(74) *Attorney, Agent, or Firm* — Finnegan, Henderson, Farabow, Garrett & Dunner LLP

(57) ABSTRACT

A hydraulic control system is disclosed. The hydraulic control system may have a pump configured to pressurize a fluid, an actuator, a position sensor associated with the actuator and configured to generate a first signal indicative of a position of the actuator, and a circuit fluidly connecting the pump to the actuator. The hydraulic control system may also have a valve associated with the circuit and configured to move from a first position, at which fluid relief from the circuit is inhibited, toward a second position, at which fluid is relieved from the circuit through the valve, when a pressure of fluid within the circuit exceeds a threshold setting of the valve. The hydraulic control system may additionally have a controller in communication with the position sensor and the valve. The controller may be configured to selectively cause adjust the threshold setting of the valve based on the first signal.

14 Claims, 3 Drawing Sheets

(56) References Cited

U.S. PATENT DOCUMENTS

2005/0204735 A1 9/2005 Sugano
2009/0071144 A1 3/2009 Ma et al.
2009/0255248 A1* 10/2009 Bitter ..... 60/477

* cited by examiner

HYDRAULIC CONTROL SYSTEM HAVING VARIABLE PRESSURE RELIEF

TECHNICAL FIELD

The present disclosure relates generally to a hydraulic control system, and more particularly, to a hydraulic control system having variable pressure relief.

BACKGROUND

Machines such as wheel loaders, backhoes, fork lifts, and other types of heavy equipment use multiple actuators supplied with hydraulic fluid from one or more pumps on the machine to accomplish a variety of tasks. Movement of these actuators is typically controlled based on an actuation position of an operator interface device. For example, when a machine operator pulls a joystick controller rearward or pushes the joystick controller forward, one or more lift actuators mounted on the machine either extend to lift a work tool away from a ground surface or retract to lower the work tool back toward the ground surface. Similarly, when the operator pushes the same or another joystick controller to the left or right, tilt actuators mounted on the wheel loader either extend to dump the work tool downward toward the ground surface or retract to rack the work tool backward away from the work surface. The forces generated by the lift and tilt actuators are related to hydraulic surface areas within each of the actuators and a pressure of fluid supplied to the actuators.

The pressure of the fluid supplied to the actuators is generally limited by one or more pressure relief valves to avoid damage to system components. Each pressure relief valve can be situated, for example, between a control valve and a corresponding actuator, and configured to selectively open and relieve actuator pressures when the pressures reach or exceed a particular level. Historically, pressure relief valves have been hydro-mechanical components that are spring-biased and configured to move between two positions based on actuator pressures, including a flow-passing position at which actuator pressure is relieved, and a flow-blocking position at which actuator pressure is allowed to build. The pressure threshold at which the conventional pressure relief valve is moved to the flow-passing position is dependent upon a factory-set spring bias (i.e., a threshold setting), and remains unchanged during operation of the machine throughout the machine's life.

Although successful at helping to avoid damage to system components in some situations, pressure relief valves of the type described above may still be less than optimal. In particular, a pressure relief valve that has only a single pressure setting may not provide all the functionality required to fully protect system components and/or loads carried by the machine. For example, during movement of an actuator under maximum system pressure (i.e., a pressure just less than the pressure required to open the relief valve), the actuator can be damaged when a travel end-stop of the actuator is reached (i.e., when the actuator hits the end-stop during travel at full force).

An alternative type of pressure relief valve is disclosed in U.S. Pat. No. 3,937,128 that issued to Hicks et al. on Feb. 10, 1976 (the '128 patent). In particular, the '128 patent describes a dual stage pressure relief valve for use with a hydraulic jack. The relief valve is configured to establish a relatively low operating pressure for normally actuating the hydraulic jack, and to selectively increase the system pressure during a selected operation. The relief valve is switched between low- and high-pressure settings based on movement of the hydraulic jack near an end-of-stroke position.

While the dual pressure settings of the '128 patent may increase the functionality of the pressure relief valve, it may lack applicability. In particular, the step-change in pressure levels may be problematic in heavy-loading situations, where a sudden shift from high-pressure to low-pressure could cause load instabilities. In addition, the hydraulic system of the '128 patent still does not address damage that can occur at an end-of-stroke position during actuator movement at high-pressure.

The present disclosure is directed to overcoming one or more of the problems set forth above and/or other problems of the prior art.

SUMMARY

In one aspect, the present disclosure is directed to a hydraulic control system. The hydraulic control system may include a pump configured to pressurize a fluid, an actuator, a position sensor associated with the actuator and configured to generate a first signal indicative of a position of the actuator, and a circuit fluidly connecting the pump to the actuator. The hydraulic control system may also have a valve associated with the circuit and configured to move from a first position, at which fluid relief from the circuit is inhibited, toward a second position, at which fluid is relieved from the circuit through the valve, when a pressure of fluid within the circuit exceeds a threshold setting of the valve. The hydraulic control system may additionally have a controller in communication with the position sensor and the valve. The controller may be configured to selectively cause adjust the threshold setting of the valve based on the first signal.

In another aspect, the present disclosure is directed to a method of operating a machine. The method may include pressurizing fluid with a pump, directing pressurized fluid into an actuator via a circuit to move the actuator, sensing a position of the actuator with a position sensor, and responsively generating a first signal indicative of the position. The method may also include moving a valve from a first position, at which fluid relief from the circuit through the valve is inhibited, toward a second position, at which fluid is relieved from the circuit through the valve when a pressure of fluid within the circuit exceeds a threshold setting of the valve. The method may further include adjusting the threshold setting of the valve based on the first signal.

DETAILED DESCRIPTION

Figure 1:
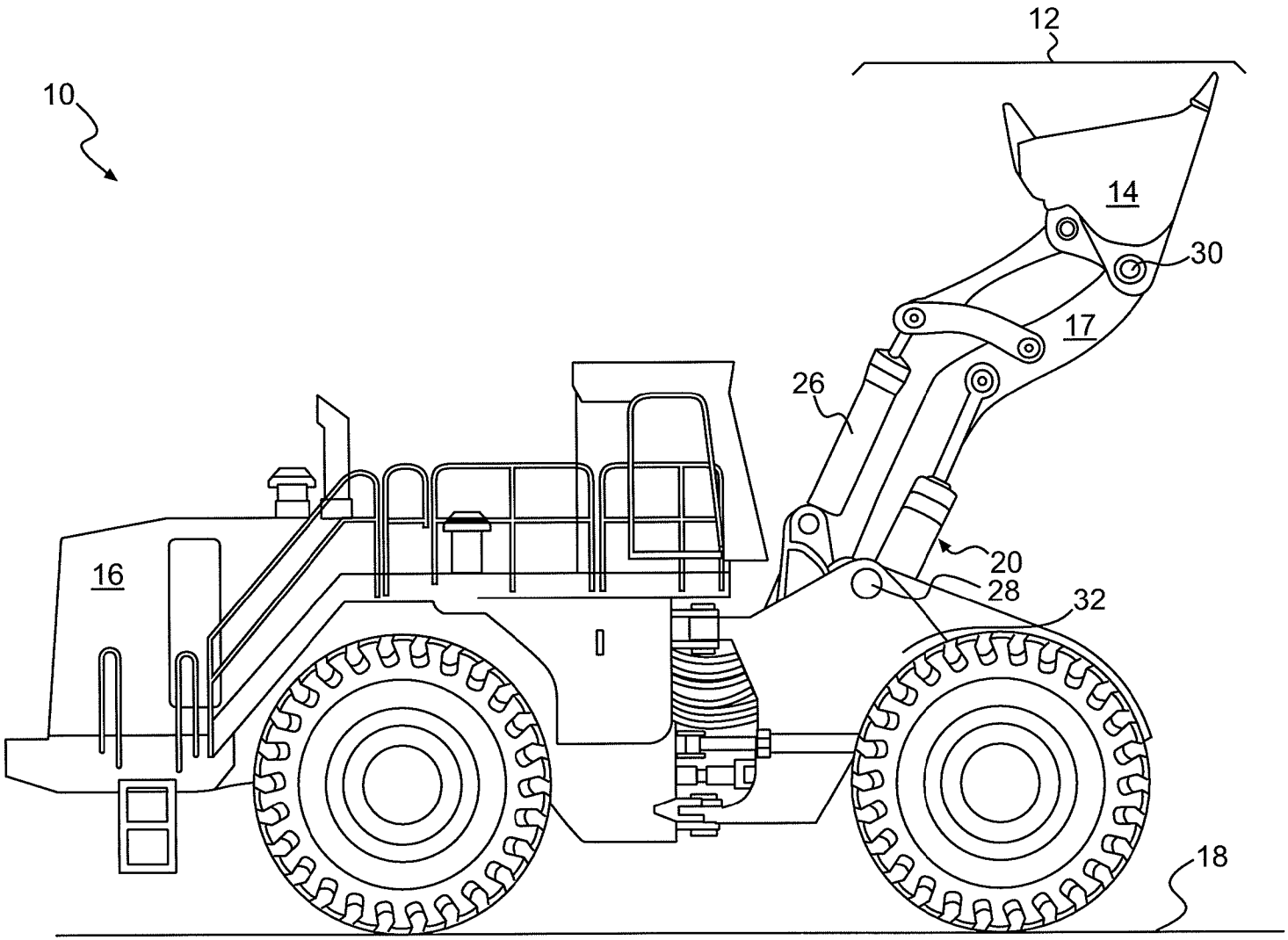
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or another industry known in the art. For example, machine 10 may be a material moving machine such as the loader depicted in FIG. 1. Alternatively, machine 10 could embody a fork lift, an excavator, a backhoe, or another similar machine. Machine 10 may include, among other things, a linkage system 12 configured to move a work tool 14, and a prime mover 16 that provides power to linkage system 12.

Linkage system 12 may include structure acted on by fluid actuators to move work tool 14. Specifically, linkage system 12 may include a boom (i.e., a lifting member) 17 that is vertically pivotable about a horizontal axis 28 relative to a ground surface 18 by a pair of adjacent, double-acting, hydraulic cylinders 20 (only one shown in FIG. 1). Linkage system 12 may also include a single, double-acting, hydraulic cylinder 26 connected to tilt work tool 14 relative to boom 17 in a vertical direction about a horizontal axis 30. Boom 17 may be pivotably connected at one end to a body 32 of machine 10, while work tool 14 may be pivotably connected to an opposing end of boom 17. It should be noted that alternative linkage configurations may also be possible.

Numerous different work tools 14 may be attachable to a single machine 10 and controlled to perform a particular task. For example, work tool 14 could embody a bucket (shown in FIG. 1), a fork arrangement, a blade, a shovel, a ripper, a dump bed, a broom, a snow blower, a propelling device, a cutting device, a grasping device, or another task-performing device known in the art. Although connected in the embodiment of FIG. 1 to lift and tilt relative to machine 10, work tool 14 may alternatively or additionally pivot, rotate, slide, swing, or move in any other appropriate manner.

Prime mover 16 may embody an engine such as, for example, a diesel engine, a gasoline engine, a gaseous fuel-powered engine, or another type of combustion engine known in the art that is supported by body 32 of machine 10 and operable to power the movements of machine 10 and work tool 14. It is contemplated that prime mover may alternatively embody a non-combustion source of power, if desired, such as a fuel cell, a power storage device (e.g., a battery), or another source known in the art. Prime mover 16 may produce a mechanical or electrical power output that may then be converted to hydraulic power for moving hydraulic cylinders 20 and 26.

Figure 2:
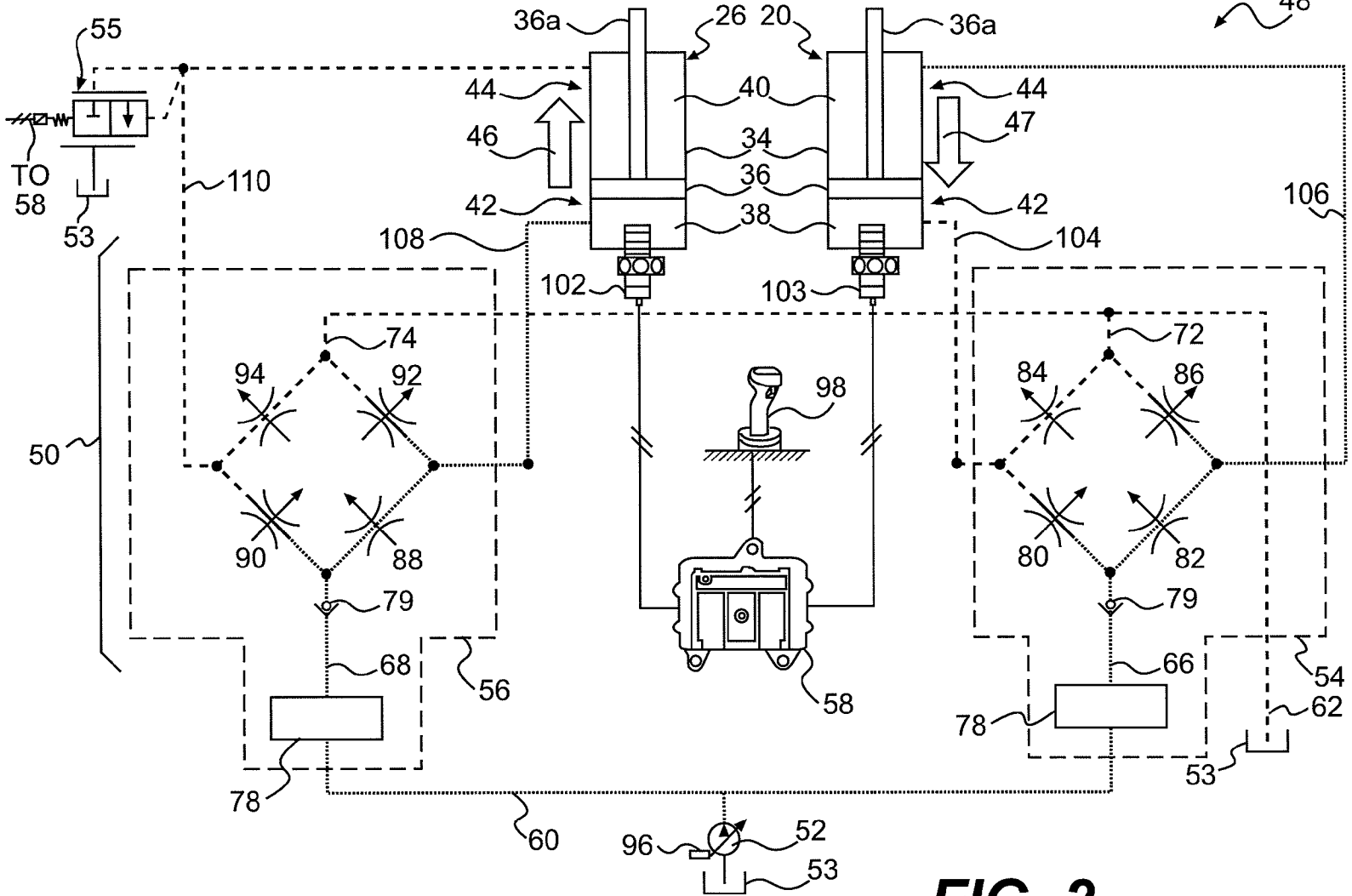
FIG. 2 is a schematic illustration of an exemplary disclosed hydraulic control system that may be used in conjunction with the machine of FIG. 1.

For purposes of simplicity, FIG. 2 illustrates the composition and connections of only hydraulic cylinders 26 and one of hydraulic cylinders 20. It should be noted, however, that machine 10 may include other hydraulic actuators of similar composition connected to move the same or other structural members of linkage system 12 in a similar manner, if desired.

As shown in FIG. 2, each of hydraulic cylinders 20 and 26 may include a tube 34 and a piston assembly 36 arranged within tube 34 to form a first chamber 38 and a second chamber 40. In one example, a rod portion 36*a* of piston assembly 36 may extend through an end of second chamber 40. As such, second chamber 40 may be associated with a rod-end 44 of its respective cylinder, while first chamber 38 may be associated with an opposing head-end 42 of its respective cylinder.

First and second chambers 38, 40 may each be selectively supplied with pressurized fluid and drained of the pressurized fluid to cause piston assembly 36 to displace within tube 34, thereby changing an effective length of hydraulic cylinders 20, 26 and moving work tool 14 (referring to FIG. 1). A flow rate of fluid into and out of first and second chambers 38, 40 may relate to a velocity of hydraulic cylinders 20, 26 and work tool 14, while a pressure differential between first and second chambers 38, 40 may relate to a force imparted by hydraulic cylinders 20, 26 on work tool 14. An expansion (represented by an arrow 46) and a retraction (represented by an arrow 47) of hydraulic cylinders 20, 26 may function to assist in moving work tool 14 in different manners (e.g., lifting and tilting work tool 14, respectively).

To help regulate filling and draining of first and second chambers 38, 40, machine 10 may include a hydraulic control system 48 having a plurality of interconnecting and cooperating fluid components. Hydraulic control system 48 may include, among other things, a valve stack 50 at least partially forming a circuit between hydraulic cylinders 20, 26, a pump 52 driven by prime mover 16 to provide pressurized fluid to cylinders 20, 26 via valve stack 50, and a tank 53 configured to hold a supply of the fluid. Hydraulic control system 48 may further include a controller 58 in communication with prime mover 16 and valve stack 50 to control corresponding movements of hydraulic cylinders 20, 26.

Valve stack 50 may include a lift valve arrangement 54, a tilt valve arrangement 56, and, in some embodiments, one or more auxiliary valve arrangements (not shown) that are fluidly connected to receive and discharge pressurized fluid in parallel fashion. In one example, valve arrangements 54, 56 may include separate bodies bolted to each other to form valve stack 50. In another embodiment, each of valve arrangements 54, 56 may be stand-alone arrangements, connected to each other only by way of external fluid conduits (not shown). It is contemplated that a greater number, a lesser number, or a different configuration of valve arrangements may be included within valve stack 50, if desired. For example, a swing valve arrangement (not shown) configured to control a swinging motion of linkage system 12, one or more travel valve arrangements, and other suitable valve arrangements may be included within valve stack 50.

Each of lift and tilt valve arrangements 54, 56 may regulate the motion of their associated fluid actuators. Specifically, lift valve arrangement 54 may have elements movable to simultaneously control the motions of both of hydraulic cylinders 20 and thereby lift boom 17 and work tool 14 relative to ground surface 18. Likewise, tilt valve arrangement 56 may have elements movable to control the motion of hydraulic cylinder 26 and thereby tilt work tool 14 relative to boom 17.

Valve arrangements 54, 56 may be connected to regulate flows of pressurized fluid to and from hydraulic cylinders 20, 26 via common passages. Specifically, valve arrangements 54, 56 may be connected to pump 52 by way of a common supply passage 60, and to tank 53 by way of a common drain passage 62. Lift and tilt valve arrangements 54, 56, in the disclosed embodiment, are shown as being connected in parallel to common supply passage 60 by way of individual fluid passages 66 and 68, respectively, and in parallel to common drain passage 62 by way of individual fluid passages 72 and 74, respectively. It is contemplated, however, that lift and tilt valve arrangements 54, 56 may alternatively be disposed in series, if desired. For example, tilt valve arrangement 56 could be disposed upstream of lift valve arrangement 54 (i.e., between pump 52 and lift valve arrangement 54), such that tilt valve arrangement has priority over flow from pump 52. A pressure compensating valve 78 and/or a check valve 79 may be disposed within each of fluid passages 66, 68 to provide a unidirectional supply of fluid having a substantially constant flow to valve arrangements 54, 56. Pressure compensating valves 78 may be pre- (shown in FIG. 2) or post-compensating (not shown) valves movable, in response to a differential pressure, between a flow passing position and a flow blocking position such that a substantially constant flow of fluid is provided to valve arrangements 54 and 56, even when a pressure of the fluid directed to pressure compensating valves 78 varies. It is contemplated that, in some applications, pressure compensating valves 78 and/or check valves 79 may be omitted or positioned differently, as desired.

Each of lift and tilt valve arrangements 54, 56 may be substantially identical and include four independent metering valves (IMVs). Of the four IMVs, two may be generally associated with fluid supply functions, while two may be generally associated with drain functions. For example, lift valve arrangement 54 may include a head-end supply valve 80, a rod-end supply valve 82, a head-end drain valve 84, and a rod-end drain valve 86. Similarly, tilt valve arrangement 56 may include a head-end supply valve 88, a rod-end supply valve 90, a head-end drain valve 92, and a rod-end drain valve 94. Each of the supply valves 80, 82, 88, and 90 may be disposed between a supply passage 66 or 68 and individual head- or rod-end passages 104, 106, 108, 110 that lead to first and second chambers 38, 40 of hydraulic cylinders 20, 26, respectively, and be configured to regulate a flow rate of pressurized fluid in response to a command from controller 58. Likewise, each of drain valves 84, 86, 92, and 94 may be disposed between a drain passage 72 or 74 and individual head- or rod-end passages 104-110, respectively, and be configured to regulate a flow of fluid to tank 53 in response to the command from controller 58. It is contemplated that both the supply and drain functions of lift and/or tilt valve arrangements 54, 56 may alternatively be performed by a single element associated with first chamber 38 and a single element associated with second chamber 40 of the respective actuator, or by a single element associated with both first and second chambers 38, 40, if desired.

Pump 52 may have variable displacement and be load-sense controlled to draw fluid from tank 53 and discharge the fluid at a specified elevated pressure to valve arrangements 54, 56. That is, pump 52 may include a stroke-adjusting mechanism 96, for example a swashplate or spill valve, a position of which is hydro-mechanically adjusted based on a sensed load of hydraulic control system 48 to thereby vary an output (e.g., a discharge rate) of pump 52. The displacement of pump 52 may be adjusted from a zero displacement position at which substantially no fluid is discharged from pump 52, to a maximum displacement position at which fluid is discharged from pump 52 at a maximum rate. In one embodiment, a load-sense passage (not shown) may direct a pressure signal to stroke-adjusting mechanism 96 and, based on a value of that signal (i.e., based on a pressure of signal fluid within the passage), the position of stroke-adjusting mechanism 96 may change to either increase or decrease the output of pump 52 and thereby maintain the specified pressure. Pump 52 may be drivably connected to prime mover 16 of machine 10 by, for example, a countershaft, a belt, or in another suitable manner. Alternatively, pump 52 may be indirectly connected to prime mover 16 via a torque converter, a gear box, an electrical circuit, or in any other manner known in the art.

Tank 53 may constitute a reservoir configured to hold a supply of fluid. The fluid may include, for example, a dedicated hydraulic oil, an engine lubrication oil, a transmission lubrication oil, or any other fluid known in the art. One or more hydraulic circuits within machine 10 may draw fluid from and return fluid to tank 53. It is also contemplated that hydraulic control system 48 may be connected to multiple separate fluid tanks, if desired.

One or more pressure relief valves may be associated with hydraulic control system 48, for example a main pressure relief valve (not shown) that is associated with a main output of pump 52 at a location upstream of valve stack 50, a pressure relief valve (not shown) that is associated with lift valve arrangement 54 and/or hydraulic cylinders 20, and a pressure relief valve 55 that is associated with tilt valve arrangement 56 and hydraulic cylinder 26. For the purposes of this disclosure, only pressure relief valve 55 associated with tilt valve arrangement 56 and hydraulic cylinder 26 will be described in detail.

Pressure relief valve 55 may be a multi-setting hydro-mechanical valve that is movable between a flow-blocking first position at which fluid flow from passage 110 through pressure relief valve 55 is inhibited, and a flow-passing second position at which passage 110 is connected to tank 53 via pressure relief valve 55. Pressure relief valve 55 may moved from the first position toward the second position based on pressure of fluid within passage 110 (i.e., when a pressure within passage 110 exceeds a current threshold setting of pressure relief valve 55), and spring-biased toward the first position. It is contemplated that pressure relief valve 55 may be movable to any position between the first and second positions to vary an amount of restriction on and corresponding flow rate of pressurized fluid through pressure relief valve 55 to tank 53. When pressure relief valve 55 is away from the first position (i.e., either in the second position or at some position between the first and second positions) and fluid is passing to tank 53, the fluid pressure within passage 110 may be relieved by a corresponding amount. Accordingly, a pressure of passage 110, at hydraulic cylinder 26, may be limited through the use of pressure relief valve 55. It should be noted that an additional single or multi-setting pressure relief valve (not shown) may be associated with passage 108, if desired.

Controller 58 may embody a single microprocessor or multiple microprocessors that include components for controlling valve arrangements 54, 56 and for adjusting the threshold setting of pressure relief valve 55 based on, among other things, input from an operator of machine 10 and/or one or more sensed operational parameters. Numerous commercially available microprocessors can be configured to perform the functions of controller 58. It should be appreciated that controller 58 could readily be embodied in a general machine microprocessor capable of controlling numerous machine functions. Controller 58 may include a memory, a secondary storage device, a processor, and any other components for running an application. Various other circuits may be associated with controller 58 such as power supply circuitry, signal conditioning circuitry, solenoid driver circuitry, and other types of circuitry.

Controller 58 may receive operator input associated with a desired movement of machine 10 by way of one or more interface devices 98 that are located within an operator station of machine 10. Interface devices 98 may embody, for example, single or multi-axis joysticks, levers, or other known interface devices located proximate an onboard operator seat (if machine 10 is directly controlled by an onboard operator) or located within a remote station offboard machine 10. Each interface device 98 may be a proportional-type device that is movable through a range from a neutral position to a maximum displaced position to generate a corresponding displacement signal that is indicative of a desired velocity of work tool 14 caused by hydraulic cylinders 20, 26, for example desired lift and tilt velocities of work tool 14. The desired lift and tilt velocity signals may be generated independently or simultaneously by the same or different interface devices 98, and be directed to controller 58 for further processing.

One or more maps relating the interface device signals, the corresponding desired work tool velocities, associated flow rates, valve element positions, system pressure settings, modes of operation, and/or other characteristics of hydraulic control system 48 may be stored in the memory of controller 58. Each of these maps may be in the form of tables, graphs, and/or equations. Controller 58 may be configured to allow the operator to directly modify these maps and/or to select specific maps from available relationship maps stored in the memory of controller 58 to affect actuation of hydraulic cylinders 20, 26. It is also contemplated that the maps may be automatically selected for use by controller 58 based on sensed or determined modes of machine operation, if desired.

Controller 58 may be configured to receive input from interface device 98 and to command operation of valve arrangements 54, 56 in response to the input and based on the relationship maps described above. Specifically, controller 58 may receive the interface device signals indicative of a desired work tool lift/tilt velocities, and reference the selected and/or modified relationship maps stored in the memory of controller 58 to determine desired flow rates for the appropriate supply and/or drain elements within valve arrangements 54, 56 and the desired pressures of hydraulic control system 48. The desired flow rates can then be commanded of the appropriate supply and drain elements to cause filling of particular chambers within hydraulic cylinders 20, 26 at rates that correspond with the desired work tool velocities in the selected operational mode. Likewise, controller 58 may issue commands to pressure relief valve 55 such that the pressure setting of pressure relief valve 55 is adjusted to achieve the desired pressures within passage 110 at hydraulic cylinder 26.

Controller 58 may rely, at least in part, on information from one or more sensors during control of hydraulic cylinders 20, 26 and/or pressure relief valve 55. The information may include, for example, sensory information regarding the lift and tilt positions, lift and tilt velocities, and/or an orientation of work tool 14 relative to ground surface 18. In the disclosed embodiment, the lift and tilt position and velocity, and work tool orientation information is provided by way of a tilt sensor 102 associated with hydraulic cylinder 26 and a lift sensor 103 associated with hydraulic cylinders 20. Sensors 102, 103 may each embody a magnetic pickup-type sensor associated with a magnet (not shown) embedded within the piston assembly 36 of the different hydraulic cylinders 20, 26. In this configuration, sensors 102, 103 may each be configured to detect an extension position of the corresponding hydraulic cylinder 26, 20 by monitoring the relative location of the magnet, and generate corresponding position and/or velocity signals directed to controller 58 for further processing. It is contemplated that sensors 102, 103 may alternatively embody other types of sensors such as, for example, magnetostrictive-type sensors associated with a wave guide (not shown) internal to hydraulic cylinders 26, 20, cable type sensors associated with cables (not shown) externally mounted to hydraulic cylinders 26, 20, internally- or externally-mounted optical sensors, rotary style sensors associated with joints pivotable by hydraulic cylinders 26, 20, or any other type of sensors known in the art. From the position and/or velocity signals generated by sensors 102, 103 and based on known geometry and/or kinematics of hydraulic cylinders 26, 20 and linkage system 12, controller 58 may be configured to calculate the orientation (e.g., the tilt angle) of work tool 14 relative to body 32 and/or ground surface 18. This information may then be utilized by controller 58 during different operations, as will be described in more detail below.

Figure 3:
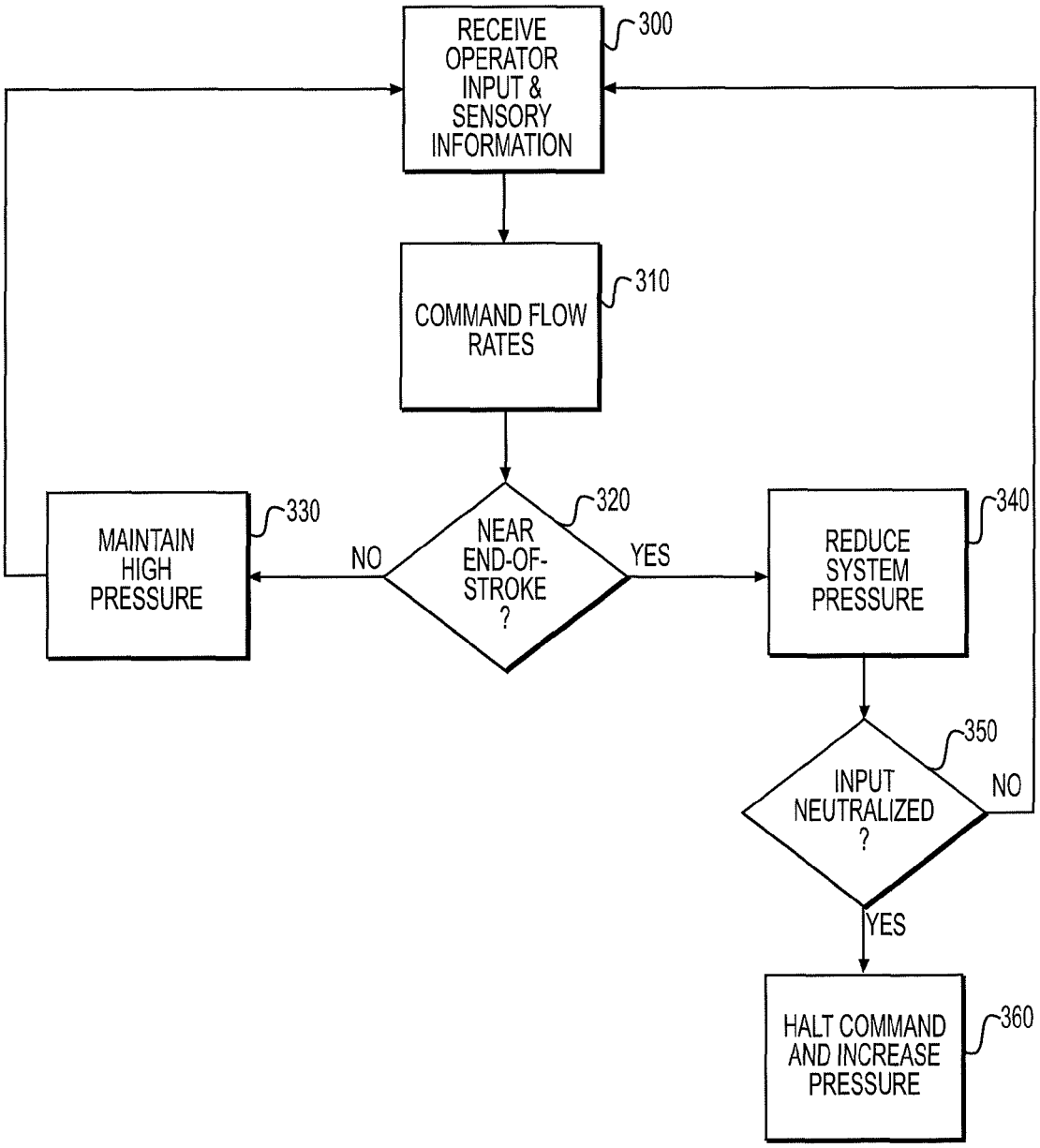
FIG. 3 is a flow chart illustrating an exemplary disclosed method performed by the hydraulic control system of FIG. 2.

FIG. 3 illustrates an exemplary operation performed by controller 58. FIG. 3 will be discussed in more detail in the following section to further illustrate the disclosed concepts.

INDUSTRIAL APPLICABILITY

The disclosed hydraulic control system may be applicable to any machine having a work tool where it is desirable to maintain different actuation pressures during manipulation of the work tool. The disclosed hydraulic control system may be used to selectively limit the pressures based on movement of the work tool in order to protect actuation components of the system. Operation of hydraulic control system 48 will now be explained.

During operation of machine 10, a machine operator may manipulate interface device 98 to request corresponding lifting and tilting movements of work tool 14. For example, the operator may move interface device 98 in the fore/aft direction to request lifting of work tool 14 downward (i.e., lowering) toward ground surface 18 and upward away from ground surface 18, respectively. The operator may also move interface device 98 in the left/right direction to request a rearward tilting (i.e., racking) of work tool 14 and a forward tilting (i.e., dumping) of work tool 14, respectively. The displacement positions of interface device 98 in the fore/aft and left/right directions may be related to operator desired lift and tilt velocities of work tool 14. Interface device 98 may generate velocity signals indicative of the operator desired lift and tilt velocities of work tool 14 during manipulation, and direct these velocity signals to controller 58 for further processing.

Controller 58 may receive operator input via interface device 98, and position and velocity, information via sensors 102 and 103 (Step 300). Controller 58 may then determine and command flow rates corresponding to the operator input in a conventional manner that result in the operator desired work tool velocities (Step 310). During actuation of hydraulic cylinder 26, as pressures within passage 110 vary, pressure relief valve 55 may be moved toward the flow-passing position by pressurized fluid within passage 110 any time a pressure of the fluid exceeds the threshold setting of pressure relief valve 55, thereby maintaining a desired pressure within passage 110. That is, when the actual fluid pressure of passage 110 is greater than the threshold setting, relief valve 55 may move at least partway toward the flow-passing position, thereby relieving the pressure within passage 110. Pressure relief valve 55 may move to a particular position between the flow-passing and flow-blocking positions that corresponds with a difference between the fluid pressure of passage 110 and the threshold setting, at which point a fluid force urging pressure relief valve 55 toward the flow-passing position may substantially balance a return force urging pressure relief valve 55 toward the flow-blocking position.

Controller 58 may be configured to vary the threshold setting at which pressure relief valve 55 begins to pass fluid to tank 53 (i.e., the return force of pressure relief valve 55) based on a position of hydraulic cylinders 20, 26 and/or an orientation of work tool 14. For example, controller 58 may ascertain, based on signals from sensor 102 and/or 103 that cylinders 26 and/or 20 are nearing an end-of-stroke position (Step 320), and responsively adjust the threshold setting at which pressure relief valve 55 moves toward the flow-passing position. When cylinders 20 and/or 26 are not near the end-of-stroke position (i.e., when cylinders 20 and/or 26 are not within a particular distance of the end-of-stroke position), controller 58 may maintain a relatively high-threshold setting that allows full-force usage of the corresponding cylinders 20, 26 (Step 330), and control may loop back to Step 300.

However, when cylinders 20 and/or 26 are determined to be nearing the end-of-stroke position, controller 58 may instead reduce the threshold setting of pressure relief valve 55 (Step 340) such that the corresponding cylinder 20, 26 is moving with a lower force when an associated end-stop is subsequently engaged at the end-of-stroke position. In one embodiment, controller 58 may be configured to gradually reduce the threshold setting as the end-of-stroke position is neared, in a linear or non-linear manner, and to reduce the threshold setting by as much as about 60%. In this same embodiment, controller 58 may only begin reducing the threshold setting after the corresponding cylinder 20, 26 is within a particular distance of the end-of-stroke position, for example when cylinder 26 is within a distance corresponding to a tilt angle range of work tool 14 of about 3-5° from a rack stop position.

After reducing the threshold setting at which movement of pressure relief valve 55 toward its flow-passing position begins, controller 58 may continue to monitor operator input to determine when operator input has been neutralized (Step 350). That is, controller 58 may determine when interface device 98 has been returned to its neutral position. Control may loop from Step 350 back to Step 300 as long as interface device 98 remains in a displaced position (i.e., away from its neutral position). However, when interface device 98 is returned to its neutral position, controller 58 may be configured to stop issuing flow-passing commands to valve stack 50, and then increase the threshold setting of pressure relief valve 55 (Step 360). In one embodiment, the threshold setting of pressure relief valve 55 may be increased to a maximum level when interface device 98 is returned to its neutral position. This increase in the threshold setting of pressure relief valve 55 may cause a corresponding increase in the pressure of passage 110, without causing an increase in force exerted on the end-stops of hydraulic cylinders 20 and/or 26, as valve arrangements associated with hydraulic cylinders 20 and 26 may have already been commanded to stop passing fluid.

The disclosed hydraulic control system may provide for protection of system components near an actuator end-of-stroke position without causing undesired and/or unexpected shifting of a lifted load. In particular, because controller 58 may reduce the threshold setting of relief valve 55 as hydraulic cylinders 20 and/or 26 nears an end-of-stroke position, the corresponding actuator may engage its end-stop with a relatively low force that does not cause significant damage to the actuator. In addition, because controller 58 may reduce the threshold setting in a gradual manner, a force balance may eventually be reached within the corresponding actuator, such that any load lifted by work tool 14 can be securely maintained in a desired position without causing step changes in the force holding the load in place. The force balance within the corresponding actuator may result in a smooth termination of the actuator and work tool movement at the end-of-stroke position.

It will be apparent to those skilled in the art that various modifications and variations can be made to the disclosed hydraulic control system. Other embodiments will be apparent to those skilled in the art from consideration of the specification and practice of the disclosed hydraulic control system. For example, although Steps 300-360 are shown and described as occurring in a particular order, it is contemplated that the order of the steps may be modified, if desired. In addition, although pressure relief valve 55 has been described as a hydro-mechanical valve having a threshold setting that is selectively adjusted by controller 58, it is contemplated that similar control strategies may be utilized with a solenoid-operated relief valve that is movable by controller 55 in response to different levels of measured pressure, if desired. It is intended that the specification and examples be considered as exemplary only, with a true scope being indicated by the following claims and their equivalents.

What is claimed is:

1. A hydraulic control system, comprising:

a pump configured to pressurize fluid;

an actuator;

a position sensor associated with the actuator and configured to generate a first signal indicative of a position of the actuator;

a circuit fluidly connecting the pump to the actuator;

a valve associated with the circuit and configured to move from a first position at which fluid relief from the circuit through the valve is inhibited, toward a second position at which fluid is relieved from the circuit through the valve, when a pressure of fluid within the circuit exceeds a threshold setting of the valve;

a controller in communication with the position sensor and the valve, the controller being configured to selectively adjust the threshold setting of the valve based on the first signal; and an operator input device movable from a neutral position toward a maximum displaced position to generate a second signal indicative of a desired actuator movement, wherein the controller is further configured to increase the threshold setting to a maximum pressure when the operator input device is returned to the neutral position.

2. The hydraulic control system of claim 1, wherein the controller is configured to vary the threshold setting only when the first signal indicates the actuator is within a threshold distance of an end position.

3. The hydraulic control system of claim 2, wherein the controller is configured to linearly vary the threshold setting based on the first signal.

4. The hydraulic control system of claim 3, wherein the controller is configured to reduce the threshold setting by 60% as the first signal indicates the actuator has reached the end position.

5. The hydraulic control system of claim 2, wherein the position sensor is configured to sense an extension of the actuator.

6. The hydraulic control system of claim 2, further including a work tool tiltable about a pivot by the actuator, wherein the position sensor is configured to sense a tilt angle of the work tool.

7. The hydraulic control system of claim 6, wherein the threshold distance corresponds with 3-5° of work tool tilt angle away from a rack stop position.

8. The hydraulic control system of claim 1, wherein the valve is movable to any position between the first and second positions based on pressure of fluid in communication with the actuator.

9. The hydraulic control system of claim 1, further including a control valve configured to control fluid flow from the pump to the actuator, wherein the valve is disposed between the control valve and the actuator.

10. A method of operating a machine, comprising:

pressurizing fluid with a pump;

directing pressurized fluid into an actuator via a circuit to move the actuator;

sensing a position of the actuator with a position sensor and responsively generating a first signal indicative of the position;

moving a valve from a first position at which fluid relief from the circuit through the valve is inhibited, toward a second position at which fluid is relieved from the circuit through the valve when a pressure of fluid within the circuit exceeds a threshold setting of the valve;

adjusting the threshold setting of the valve based on the first signal only when the first signal indicates the actuator is within a threshold distance of an end position, including reducing the threshold setting by 60% as the first signal indicates the actuator has reached the end position;

receiving operator input via an operator input device indicative of a desired actuator movement; and increasing the threshold setting when the operator input device is placed in the neutral position, wherein increasing the threshold setting includes increasing the threshold setting to a maximum pressure.

11. The method of claim 10, wherein sensing a position includes sensing an extension of the actuator.

12. The method of claim 10, wherein sensing a position includes sensing a tilt angle of work tool that is movable by the actuator.

13. The method of claim 12, wherein the threshold distance corresponds with 3-5° of work tool tilt angle away from a rack stop position.

14. A hydraulic control system, comprising:

a work tool tiltable about a pivot point;

an actuator connected to tilt the work tool;

a position sensor configured to generate a first signal indicative of a tilt angle of the work tool;

a pump configured to pressurize fluid;

a circuit fluidly connecting the pump to the actuator;

a valve associated with the circuit and configured to move from a first position at which fluid relief from the circuit through the valve is inhibited, toward a second position at which fluid is relieved from the circuit through the valve, when a pressure of fluid within the circuit exceeds a threshold setting of the valve;

an operator input device movable from a neutral position toward a maximum displaced position to generate a second signal indicative of a desired movement of the work tool; and a controller in communication with the position sensor and the valve, the controller being configured to:

make a determination that the work tool is nearing a rack stop position based on the first signal;

reduce the threshold setting of the valve based on the determination in an amount based on the first signal; and increase the threshold setting when the second signal indicates the operator input device is placed in the neutral position, wherein the controller is configured to increase the threshold setting to a maximum pressure when the second signal indicates the operator input device is placed in the neutral position.

* * * * *